US005168476A

United States Patent [19]

Ganter et al.

[11] Patent Number: 5,168,476

[45] Date of Patent: Dec. 1, 1992

[54] ALARM CLOCK

[75] Inventors: Wolfgang Ganter, Schramberg; Roland Maurer, Lauterbach; Heinrich Oertel, Tennenbronn, all of Fed. Rep. of Germany

[73] Assignee: Junghans Uhren GmbH, Schramberg, Fed. Rep. of Germany

[21] Appl. No.: 880,034

[22] Filed: May 8, 1992

[30] Foreign Application Priority Data

May 17, 1991 [DE] Fed. Rep. of Germany ... 9106112[U]

[51] Int. Cl.[5] ..... G04B 27/08

[52] U.S. Cl. ..... 368/74; 368/250

[58] Field of Search ..... 368/72-74, 368/243-244, 250, 252

[56] References Cited

U.S. PATENT DOCUMENTS

| | | | |
|---|---|---|---|
| 3,783,599 | 1/1974 | Tanaka | 368/72 |
| 3,996,734 | 12/1976 | Kitai et al. | 368/250 |
| 4,196,583 | 4/1980 | Komaki | 368/73 |
| 4,209,969 | 7/1980 | Kitai et al. | 368/250 |
| 4,212,155 | 7/1980 | Ogihara et al. | 368/250 |
| 4,645,357 | 2/1987 | Allgaier et al. | 368/187 |
| 4,657,404 | 4/1987 | Ogihara et al. | 368/74 |

FOREIGN PATENT DOCUMENTS

| | | |
|---|---|---|
| 2609871 | 5/1982 | Fed. Rep. of Germany . |
| 3934383 | 4/1991 | Fed. Rep. of Germany . |

*Primary Examiner*—Vit W. Miska

*Attorney, Agent, or Firm*—Burns, Doane, Swecker & Mathis

[57] ABSTRACT

A radio-controlled timepiece includes a clock face, a hands assembly mounted for rotation about an axis in front of the clock face, and an alarm setting mechanism. The alarm setting mechanism comprises a minute setting disk which is driven by an hour setting disk. A manually rotatable transparent support disk is mounted in front of the clock face for rotation about the same axis as the hands assembly. The support disk carries a marker which, when the support member is rotated, is moved to indicate a particular hour and minute indicator on the clock face. The support disk is connected to the hour setting disk to rotate the latter which, in turn, rotates the minute setting disk. The support disk is accessible to rotation at the front of the clock. The hour and minute setting disks are preferably connected to an alarm time storage device by means of conductive fingers which are mounted on the disks and which are engageable with concentric conductive strips mounted on a stationary part of the clock.

14 Claims, 3 Drawing Sheets

ALARM CLOCK

BACKGROUND OF THE INVENTION

The invention concerns an alarm clock and preferably an alarm mechanism for an autonomous radio-controlled timepiece.

It is known that the cam engaging mechanism usually found in alarm clocks for the actuation of the electromechanical switching element to activate an electroacoustic alarm signal generator involves a tolerance or play of several minutes. Such response inaccuracies are not desirable, especially in the case of an autonomous radio-controlled timepiece for the latter, the state of the display is quasi-continuously monitored and, if necessary, corrected by a radio signal, the most accurate technical time basis. If the autonomous timepiece is offered to customers as the most accurate clock of the world, there should not occur a deviation of several minutes for an alarm signal. Such a timepiece is disclosed in DE-OS 39 34 383.

An alarm actuating angular position query, is somewhat more accurate (see U.S. Pat. No. 4,209,969 for example). There, by means of a manual knob, a minute setting disk is lockingly rotated by way of a gear and, in turn, it indexes an hour setting disk forward by a single hour division. The setting disks are equipped with contact springs, which scan over contact plates rotated by the hand mechanism and which lead to the actuation of the signal generator when the wheels of the alarm clockworks occupy a predetermined actuating angular position. However, such a setting operation from the manual rotating knob through the minute switching disk to the hour switching disk requires, especially in the case of long setting distances, a time-consuming moving effort on the poorly handling rotating knob and a high installation volume for such an operational coupling and for the mutually coordinated digital representations of the instantaneous setting disk positions.

In view of these facts, it is the object of the invention to equip an alarm clock of the above-described type with an alarm signal actuating apparatus that is simple to operate, which may be built into an alarm clock inexpensively by virtue of its compact configuration, and which is suitable for installation as an accessory for a radio-controlled timepiece with a hands display because of its extremely accurate response accuracy.

SUMMARY OF THE INVENTION

This object is attained according to the present invention wherein an alarm clock comprises a clock base, and a hands assembly mounted for rotation in front of the clock face about a central axis. An alarm setting mechanism comprises an hour setting disk and a minute setting disk disposed behind the clock face and rotatably interconnected by gearing. The minute setting disk carries minute symbols which are alignable with a display window in the clock face. A manually rotatable marker is mounted in front of the clock face for rotation about the central axis. The marker is connected to the hour disk to rotate the latter. A turning structure is accessible at the front of the clock and is connected to the marker for rotating the marker to a desired alarm time. The rotation of the marker produces rotation of the hour setting disk which, in turn, produces rotation of the minute setting disk.

Preferably, the marker is disposed on a marker support member which is mounted for rotation in front of the clock face. That support member is preferably formed of a transparent material and a manually rotatable ring is connected fixedly in rotation to an outer periphery of the support member to facilitate rotation by the user.

According to the invention, in the case of manual alarm setting a motional transmission takes place, i.e., with the direct setting of the marker indicating the time of the alarm signal actuation in front of the face of the lock.

The manual rotation of this marker can be made very convenient by a large crystal circumference or an operating lunette set onto the rim. The rotation of the crystal and thus of the actuating marker, in turn, directly effects a corresponding rotation of the hour setting disk, which then rotates by gear transmission the engaging and digitally indicating minute setting disk in a known manner, with the hour setting disk rotating the minute setting disk 12 times faster. Consequently, during each hour scaling of the actuating marker in front of the clock face the minute displays associated with the angular positions appear in succession in the display window, for example in locked-in five-minute intervals, so that a signal indication accurate within five minutes may be set as conveniently as possible with an unambiguous display. The information in the radio timepiece concerning the seconds-zero point in time may then be used as an additional criterion for the actuation of the alarm signal emission with seconds accuracy at the digitally displayed five minute point in time of the hour displayed in an analog manner.

In any case, the invention provides an alarm clock which combines the utmost precision of the time display in a classic clock face format with (a) the ergonomically advantageous manipulation of a large setting rim, which again is located directly over the clock face and thus is immediately associated with the minutes time display; and (b) the precise digital display of the alarm signal minute setting in locked-in five minute intervals for a highly precise signal generation exactly at the set time, actuated by an axially flat coding disk apparatus located behind the clock face support, the coding disk apparatus being rotated directly by the setting rim for the signal generator marker.

BRIEF DESCRIPTION OF THE DRAWINGS

The objects and advantages of the invention will become apparent from the following detailed description of a preferred embodiment thereof in connection with the accompanying drawings in which like numerals designate like elements, and in which.

DETAILED DESCRIPTION OF A PREFERRED EMBODIMENT OF THE INVENTION

Figure 1:
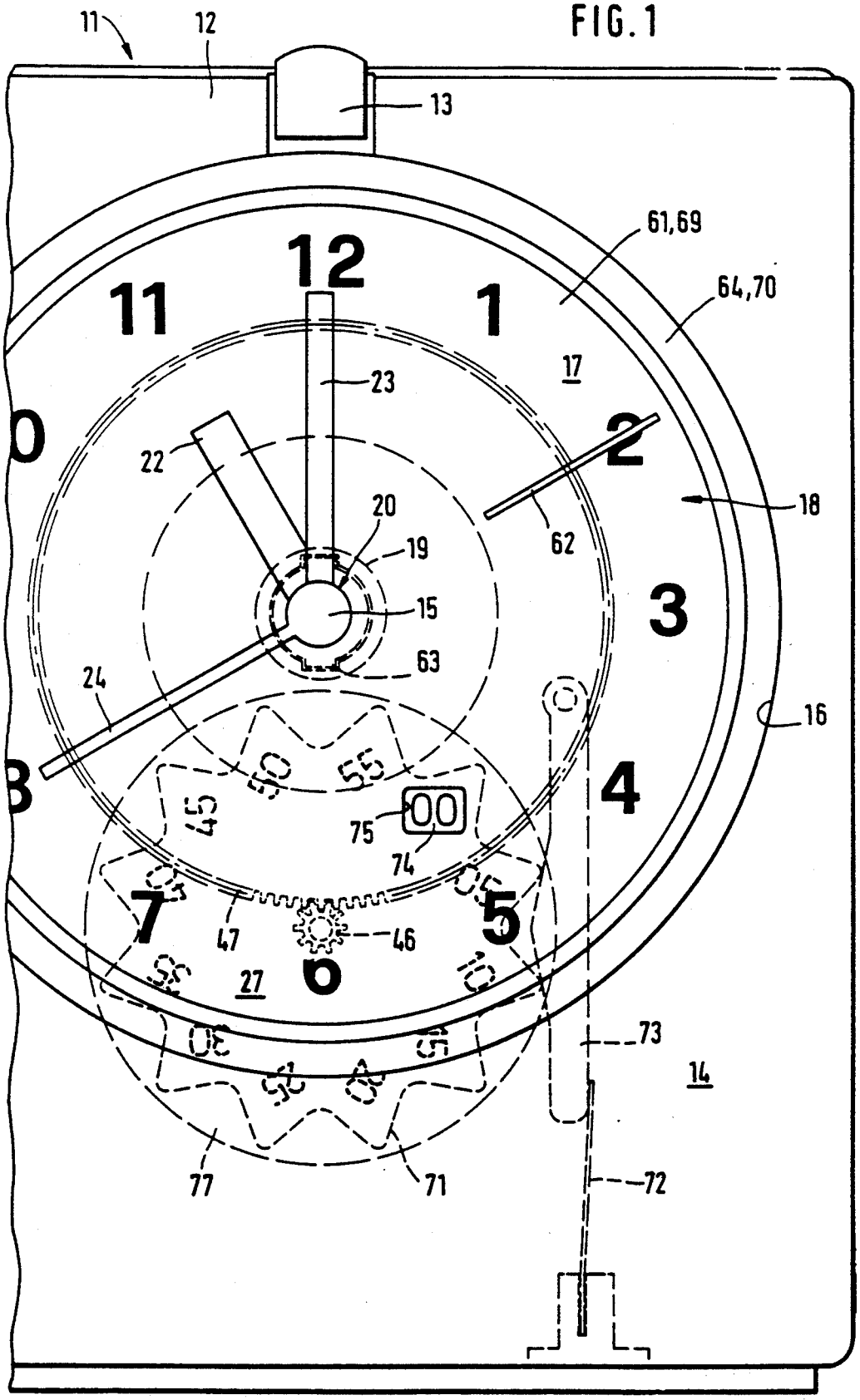
FIG. 1 is a fragmentary front elevational view of an alarm clock with a rotating lunette ring for the actuation of an alarm setting mechanism according to the invention.
Figure 2:
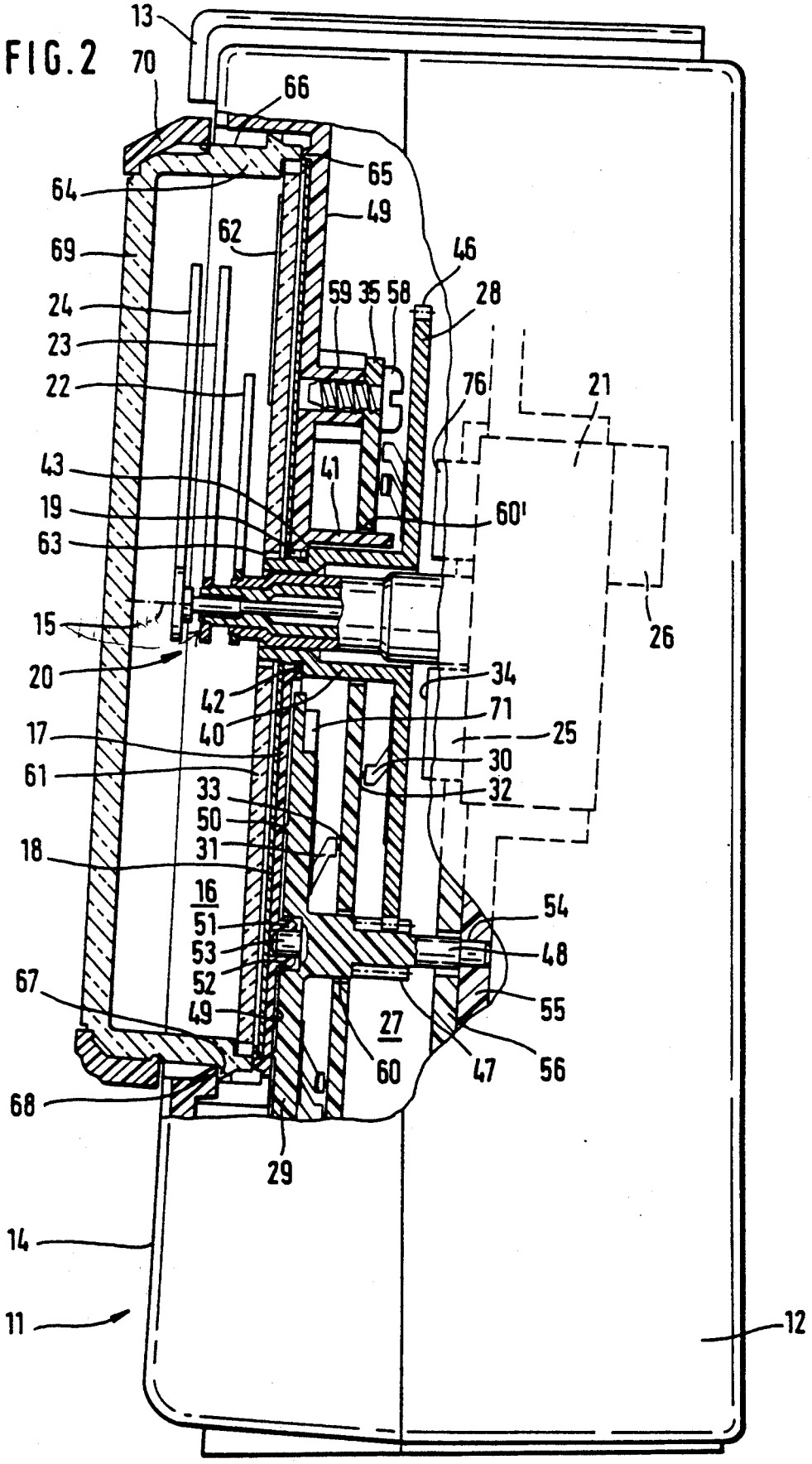
FIG. 2 is a side elevational view of the alarm clock of FIG. 1 partially sectioned in a vertical direction.

The radio timepiece alarm clock 11 comprises a plastic case 12 assembled of a plurality of parts, and having at least one signal deactivating button 13 in its top wall. On the viewing side 14 a depression 16 concentrically surrounds a coaxial set-hands arbor 15, with the back 17 of the depression 16 being provided with a clock face 18 (for example printed, adhesively bonded or overlaid). A shaft assembly 20 extends coaxially and telescopingly through an opening 19 formed in the face 18. The shaft assembly is connected to a drive mechanism 21 mounted behind the back 17 of the face. The shaft assembly 20 carries the hour hand 22, the minute hand 23 and optionally a seconds hand 24. The hands are situated in front of the bottom 17 on the viewing side, and move across the face 18, as is shown. The seconds hand 24 is connected to a center shaft of the shaft assembly. The drive mechanism 21 is equipped with a hands position detector 25, which detects the instantaneous position of the hands 22 nd 23 and 24, for example by utilizing a light barrier which determines when the hands pass through a reference position, and then counting the skipping advance of the hands produced by a drive motor 26, as is known from radio-controlled timepieces with hands (e.g., see U.S. Pat. No. 4,645,357).

The radio-controlled alarm clock according to the invention includes an alarm signal actuating mechanism which differs from the cam engaging mechanism usually found in mechanical alarm clocks. This is because the switching accuracy (i.e., the actuation of the alarm signal upon attaining a predetermined point in time) of such conventional mechanisms would be considerably less than the extremely accurate time display of a radio-controlled timepiece which employs periodic monitoring and possible correction of the actual angular position of each of the hands 22, 23, 24 on the basis of received and decoded time telegrams.

Figure 5:
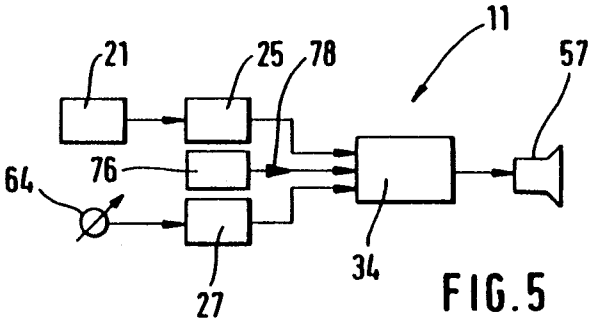
FIG. 5 is a block circuit diagram for controlling the alarm device.

Instead, position coding is provided for the alarm signal actuating mechanism of the present invention. That mechanism has a manually set hour switching disk 28 and a minutes switch disk 29 driven by it. The contact disks 28, 29 are equipped with contact springs 30, 31, respectively, which scan, as a function of the angular positions of the switch disks, respective stationary strip conductors 32, 33. The contact springs 31, 32 preferably have several radially spaced fingers in order to code angular positions for the bridging over of certain strip conductors (see German DE 26 09 871, FIG. 6). The strip conductors are connected to a signal storage device 27 which, in turn, is connected to a comparator 34 along with the hands position detector 25 (see FIG. 5). Thus electrical connection requires no collector slide rings or the like. The strip conductors 32, 33 preferably are located on opposing surfaces of a common insulating support 35 disposed in a space defined axially between the two radially overlapping switch disks 28, 29. This leads desirably to an axially compact configuration, and also simplifies the alignment of the contact springs 30, 31 with the strip conductors 32, 33. The interconnections required by the coding technology between bilateral strip conductors 32, 33 on the support 35 may be realized by through-hole plating in a favorable and space saving manner relative to the circuit layout, as is known from the technology of multilayer circuit boards for electronic circuit components.

Figure 4:
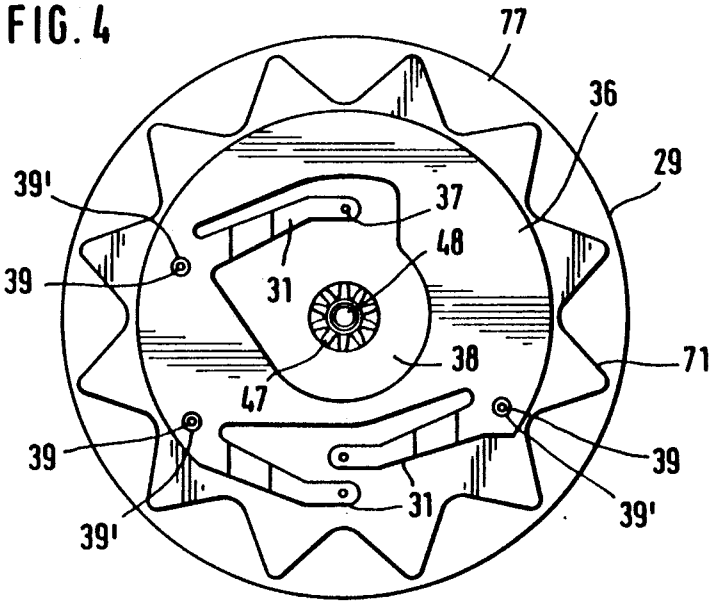
FIG. 4 is a front view of a minute setting disk according to the invention.

The multifinger contact springs 30, 31 serving as electrical short-circuit bridges between respective strip conductors 32, 33 are each conveniently formed by being punched out from a spring metal plate 36, then bent out from the plane of the plate and provided at their free ends with feeler nipples 37, as seen in more detail in FIG. 4. Each sheet metal plate 36 has a center opening 38. The plates 36 abut flush against the respective switching disks 28 and 29 in order to face the strip conductors 32 and 33. The plates are immobilized against rotation relative to the respective disks 28, 29 by means of positioning pins 39 which are molded onto the switch disks 28 and 29 and project through assembly openings 39' formed in the spring plates 36.

Figure 3:
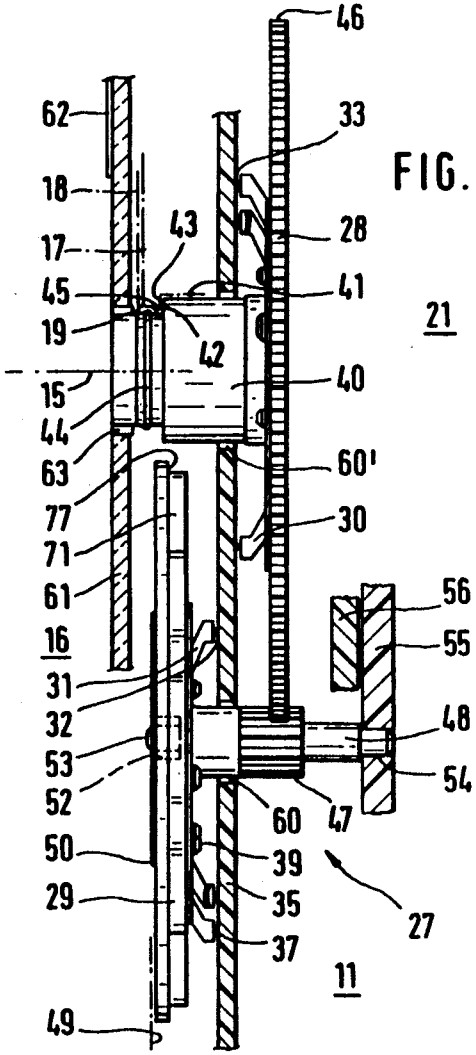
FIG. 3 is an enlarged view of a detail of FIG. 2.

The hour switch disk 28 includes a hollow shaft stub 40 arranged coaxially around the hands set-hands arbor 15 within a sleeve 41 projecting from the back 17. The sleeve 41 is preferably made in a single piece with the back 17 by injection molding. The hands shaft assembly 20 passes through the hollow shaft stub 40. A shoulder 42 on the external surface of the shaft stub 40 is axially supported by a circumferential taper 43 formed on the internal surface of the sleeve 41 behind the back 17. The support in the opposite direction is provided by an upset stop projection 44 of the shaft stub 40 (FIG. 3), which engages radial projections 45 formed on the back 17 and projecting into the center opening 19. The shaft stub 40 is thus inserted in a snap-in manner between the taper 43 and the projections 45 when the hour switch disk 28 is inserted into the face back 17.

Edge teeth 46 of the hour disk 28 mesh with a drive pinion 47 on a shaft 48 projecting from one side of the minute disk 29. The minute switch disk 29 is pressured by its contact spring 31 against the rear surface 49 of the face back 17. In order to reduce the friction of the minute disk 29 (which is revolving rapidly relative to the hour disk 28), contact between the disk 29 and the surface 49 is effected by means of axially parallel projections 50 arranged for example in a concentric ring on the disk 29. The minute disk 29 is radially guided by a pin 51 projecting from the rear surface 49 of the back and engaging a center recess in the minute disk 29. To improve rotation guidance, the pin 51 is hollow and radially interposed between the inner surface of the recess 52 and the outer surface of a pin 53 of the disk 29 which is concentrically located therein. Appropriately, the tapering end of the opposite shaft 48 is supported in an opening 54 of a stationary works plate 55, which also carries: the hands mechanism 21, a circuit board 56 for the electronic radio-controlled timepiece circuit layout 76 (autonomous stepping circuit, receiver and control circuit) and the comparator 34 (for the actuation of the electroacoustic signal generator 57), and the hands position detector 25.

The insulating support 35 is appropriately held on the rear surface 49 of the face back 17, for example as shown, by means of tapping screws 58 on the columns 59 molded toward the rear onto the back 1. This insulating support 35 includes openings 60, 60' for receiving the shaft 48 and the hollow shaft stub 40, respectively.

For the setting of the alarm signal actuating time, the support 61 is rotatably mounted in front of the clock face 18. The support 61, for example in the form of a spoked ring or preferably a transparent disk as shown, is joined fixedly in rotation to the front end of the shaft stub 40 by the positive engagement of radially outwardly projecting cams 63 received in corresponding recesses formed in the center of the signal release marker support 61.

The manual operation (rotation) of the support 61 is effected by means of a ring 64 fixedly joined in rotation with the periphery of the support 61. The ring 64 projects in the axial direction from the clock face depression 16 through the front wall 14 of the case and is supported in a manner to reduce friction. A rear edge of the support 61 engages knobs 65 formed on the clock face back 17. The ring 64 includes a nose 67 which is barb-like in cross section, and which projections from an outer circumferential surface 66 of the ring. The nose 67 engages a plurality of projections 68 formed along the periphery of the depression 16 in a snap-in manner to retain the ring.

The ring 64 may be formed of transparent plastic in one piece with a watch crystal 69. Alternatively, the crystal could comprise a separate piece which is connected to the ring 64. For aesthetic reasons and in the interest of secure gripping, the ring 64 and/or the crystal 69 is surrounded by a lunette 70 fixedly mounted on the rim and provided with a gripping edge. The support 61 carries a marker or indicator 62 on its front face to indicate the alarm time.

To set the time of the alarm signal actuation, the support 61 is rotated to the desired time position by means of the gripping lunette 70. This also rotates the hour switch disk 28 by the same angle of rotation into a corresponding angular position, wherein its contact springs 30 code the corresponding hour by contact with the associated strip conductors 32. Each manual movement of the hour switch disk 28 rotates the minute switch disk in a translation ratio of 1:12, so that it always performs one complete revolution (corresponding to 60 minutes) per each 30° rotation of the signal marker 62 (corresponding to the angular path for one hour). The contact springs 31 of the minute switch disk 29 therefore are coding on the associated strip conductors 33 a minute (between successive hours) which corresponds to the location of the marker 62 between those successive hours.

However, it would require an unacceptably high electromechanical coding effort between the contact springs 31 and the strip conductors 33 if every minute (i.e., sixty minutes) is to be evaluated as a possible position of the marker 62. It is, therefore, provided that only every fifth minute is coded, so that the alarm time may be set for each five minute interval by means of the movable marker 62. A twelve-position coarse gear ring 71 is molded onto the rear side of the minute disk 29, into which is biased a cam lever 73 by a spiral spring 72 (FIG. 1). The lever 73 is guided by a revolving collar 77 formed by a portion of the minute disk 29 to ensure the defined angular positions of the five-minute grid of the minute disk 29.

The minute of the hour selected set by means of the manually operated marker 62 is additionally visible as a digital display through a window 75 in the face back 17 (see FIG. 1). If the marker 62 is rotated, the digital displays 74 therefore jump by five minute intervals until again attaining the 00 position when the alarm time marker 62 coincides with the next hour mark on the clock face 18.

When the preset alarm time coded by the contact springs 30, 31 into the alarm time storing apparatus 27 (FIG. 5) coincides with the prevailing position of the hands 22, 23 as detected by the hands position detector 25, the comparator 34 actuates the electroacoustic alarm signal generator 57. The actuation of the latter may be controlled accurately to the second, if the computer 34 additionally queries the passage of the seconds hand through the clock face position "12" of the hands position detector 25. The alarm signal actuation will be even more exact if the pulse 78 appearing from the radio timepiece circuit 76 exactly at the onset of a minute is queries as an additional coincidence criterion by the comparator 34; it is merely necessary to ensure that the setting and alarm actuating mechanisms, which necessarily are affected by a certain clearance, have been switched through at this point; i.e., they are exhibiting a certain minimum advance relative to the actual time.

On the other hand, if in the comparator 34 the coded alarm time coincides with the complete coded instantaneous time information from the radio timepiece circuit 76, the query of the hands position detector 25 may even be eliminated. Thus, no gear clearance of the hands mechanism would affect the accuracy of the alarm signal actuation, as the minute switch disk 29 by virtue of its locking position, yields a defined minute coding within the hour set for the time of the alarm signal actuation.

Although the invention has been described in connection with a preferred embodiment thereof, it will be appreciated by those skilled in the art that additions, modifications, substitutions and deletions not specifically described may be made without departing from the spirit and scope of the invention as defined in the appended claims.

What is claimed is:

1. An alarm clock comprising:

a clock face;

a hands assembly mounted for rotation in front of said clock face about a central axis; and an alarm setting mechanism comprising:

an hour setting disk and a minute setting disk disposed behind said clock face and rotatably interconnected by gearing, said minute setting disk carrying minute symbols alignable with a display window in said clock face, a manually rotatable marker mounted in front of said clock face for rotation about said central axis, said marker being connected to said hour disk to rotate the latter, and means accessible at the front of said clock and connected to said marker for rotating said marker to a desired alarm time, the rotation of said marker producing rotation of said hour setting disk which, in turn, produces rotation of said minute setting disk.

2. An alarm clock according to claim 1 including a support member mounted for rotation about said axis in front of said clock face, said marker being disposed on said support member.

3. An alarm clock according to claim 2, wherein said support member comprises a transparent disk.

4. An alarm clock according to claim 2 including a manually rotatable ring connected fixedly in rotation to an outer periphery of said support member.

5. An alarm clock according to claim 2 including a transparent clock crystal overlying said clock face and said support member and fixedly connected in rotation with said support member.

6. An alarm clock according to claim 5, wherein said gearing is configured to rotate said minute setting disk one revolution for each thirty degree rotation of said hour setting disk.

7. An alarm clock according to claim 6, wherein said minute setting disk is fixed to a geared pinion, said hour setting disk including a geared outer peripheral edge meshing with said geared pinion.

8. An alarm clock according to claim 1 including an alarm time storage mechanism in which an alarm time determined by the position of said marker is stored, the alarm time being coded into said alarm time storage mechanism by said hour and minute setting disks.

9. An alarm clock according to claim 8, wherein said hour and minute setting disks are axially spaced and radially overlapped to form a space therebetween, an electrically insulative member disposed in said space, an array of electrically conductive strips mounted on each side of said insulative member, a multiple finger contact mounted on each of said hour and minute setting disks for rotation therewith and engaging respective ones of said arrays of strips, said strips being connected to said alarm time storing mechanism.

10. An alarm clock according to claim 1, wherein said hour setting disk includes a hollow shaft stub rotatably mounted in a central opening of said clock face.

11. An alarm clock according to claim 10 including a backing having a first side on which said clock face is mounted, said backing including a hollow sleeve extending from a second side of said backing, said shaft stub being radially supported in said sleeve, said sleeve and shaft stub including mutually engageable radial projections for confining said shaft stub axially within said sleeve.

12. An alarm clock according to claim 1, wherein said backing includes a stud projecting from said second side in radially spaced relation to said sleeve, said minute setting disk being rotatably supported on said stud.

13. An alarm clock according to claim 1, wherein said hour setting disk includes a collar, and a coarse gear ring disposed axially adjacent said collar and recessed radially inwardly relative to an outer periphery of said collar, a cam lever spring-biased into contact with said coarse gear ring to yieldably retain said minute setting disk in respective positions of adjustment.

14. An alarm clock according to claim 1, wherein said alarm clock comprises a radio-controlled timepiece in which a hands-actuating mechanism is controlled by externally supplied radio signals.

* * * * *